US007770389B2

(12) United States Patent
Sandler

(10) Patent No.: US 7,770,389 B2
(45) Date of Patent: Aug. 10, 2010

(54) MACHINE TO CONVERT GRAVITY TO MECHANICAL ENERGY

(76) Inventor: Brian Peter Sandler, 5643 Putnam, West Bloomfield, MI (US) 48323

( * ) Notice: Subject to any disclaimer, the term of this patent is extended or adjusted under 35 U.S.C. 154(b) by 376 days.

(21) Appl. No.: 11/906,464

(22) Filed: Oct. 2, 2007

(65) Prior Publication Data

US 2009/0084105 A1 Apr. 2, 2009

(51) Int. Cl.
*F03B 17/04* (2006.01)
*F03C 1/00* (2006.01)

(52) U.S. Cl. ..... 60/496; 60/495; 290/54

(58) Field of Classification Search ..... 92/15, 92/52; 60/398, 496, 495; 290/54
See application file for complete search history.

(56) References Cited

U.S. PATENT DOCUMENTS 4,054,031 A * 10/1977 Johnson ..... 60/496
4,726,188 A * 2/1988 Woolfolk ..... 60/496
5,430,333 A * 7/1995 Binford et al. ..... 290/54
6,546,726 B1 * 4/2003 Tomoiu ..... 60/495
2003/0145589 A1 * 8/2003 Tillyer ..... 60/496
2006/0130475 A1 * 6/2006 Yu ..... 60/495

FOREIGN PATENT DOCUMENTS

RU 2076243 C1 * 3/1997
WO WO 2007141653 A1 * 12/2007

* cited by examiner

*Primary Examiner*—Thomas E Lazo

(57) ABSTRACT

A empty tank submersed in a body of liquid will float to the surface, as the tank floats up it will do work. It is the goal of this machine to empty the tank after the tank has been submersed, and in the process of emptying the tank do less work than the empty tank does when it floats up.

3 Claims, 9 Drawing Sheets

MACHINE TO CONVERT GRAVITY TO MECHANICAL ENERGY

BACKGROUND OF THE INVENTION

Field of Invention

The present invention relates to energy production, more particularly converting gravity to mechanical energy.

BRIEF SUMMARY OF THE INVENTION

A empty tank submersed in a body of liquid will float to the surface, as the tank floats up it will do work. It is the goal of this machine to empty the tank after the tank has been submersed, and in the process of emptying the tank do less work than the empty tank does when it floats up.

(Machine #1)

A tank full of liquid will sink. Assuming the tank itself is heavier than liquid. As the tank full of liquid sinks, both the tank and the liquid in the tank accelerate do to the force of gravity. As the tank and the liquid in the tank accelerate they both build momentum.

The momentum of the liquid and part of the tank is the force this machine uses to empty the tank.

The machine is long and narrow, shaped somewhat like a arrow. The machine is expandable. The machine has piston-like tanks full of liquid. The piston-like tanks are inside other tanks.

As the machine falls thru the liquid it builds-up speed, than the top part of the machine is abruptly stopped, the piston-like tanks full of heavy liquid keep going, pulling themselves out of the tanks there in, expanding the machine, as the machine expands its buoyancy increases and the machine floats up.

(Machine #2)

A body falling thru a liquid will build linear momentum in the downward direction, if the body spins as it falls it will also build angular momentum. This machine uses the combination of linear momentum and angular momentum to empty the tank.

(Machine #3)

This tank-car uses the weight of the liquid above it, and some of the work the empty tank-cars do as they float up to remove the liquid from the submerged tank-car.

Figure 1:
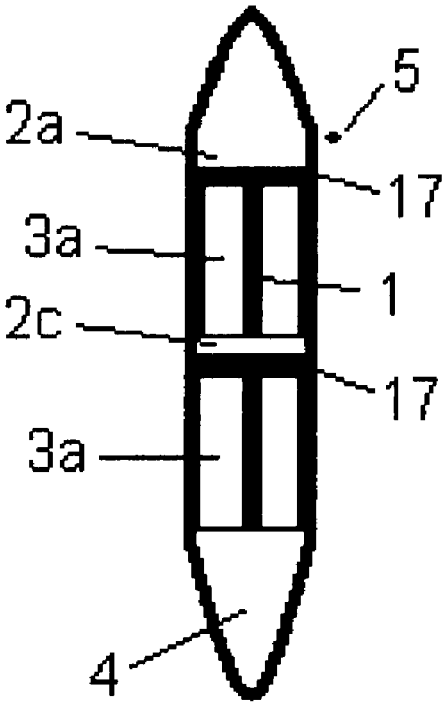
FIG. 1 is a side view of the machine #1 in its un-expanded position

Number 1. is a hole in the piston shaft, #1 allows gas to travel from tank 2*a* to tank 2*c* and from tank 2*d* to tank 2*b*, (FIG. 1)

Number 2*a*. is a tank with somewhat compressed gas in it and a piston-like tank full of liquid (3*a*) is also in it. (FIG. 1)

Number 2*c*. Is the lower tank with a piston-like tank full of liquid (3*a*) in it. (FIG. 1)

Figure 2:
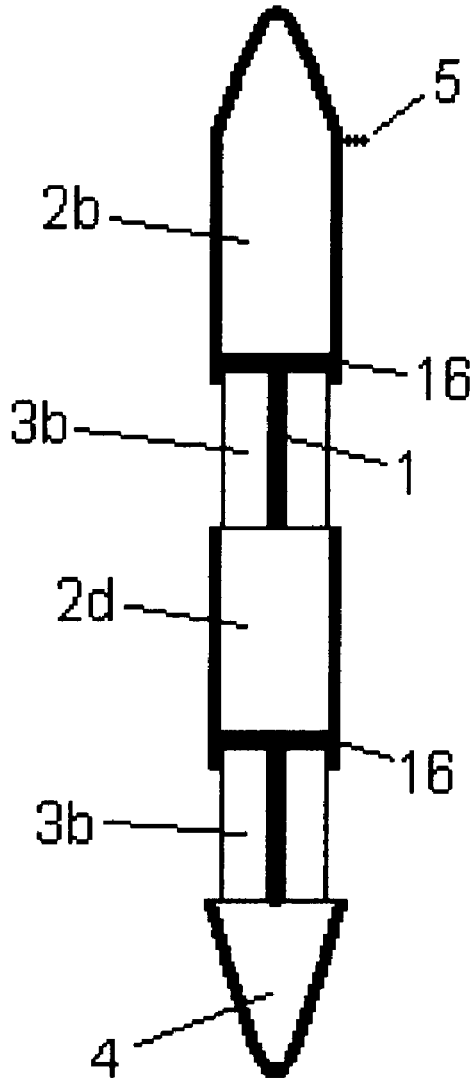
FIG. 2 is a side view of the machine #1 in its expanded position
Figure 3:
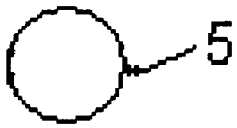
FIG. 3 is a top view looking down at the machine #1.

Number 2*b* is the same tank as 2*a* except the piston-like tank full of liquid (3*b*) has moved out of it. (FIG. 2)

Number 2*d* is the same tank as 2*c* except the piston-like tank full of liquid (3*b*) has moved out of it. (FIG. 2)

Number 3*a*. is the piston-like tank full of liquid in the un-expanded position. (FIG. 1)

Number 3*b* is the piston-like tank full of liquid in the expanded position. (FIG. 1)

Number 4 is the nose-cone full of liquid. (FIG. 1, 2)

Number 5 is a retractable stop. (FIG. 1, 2, 3)

Figure 4:
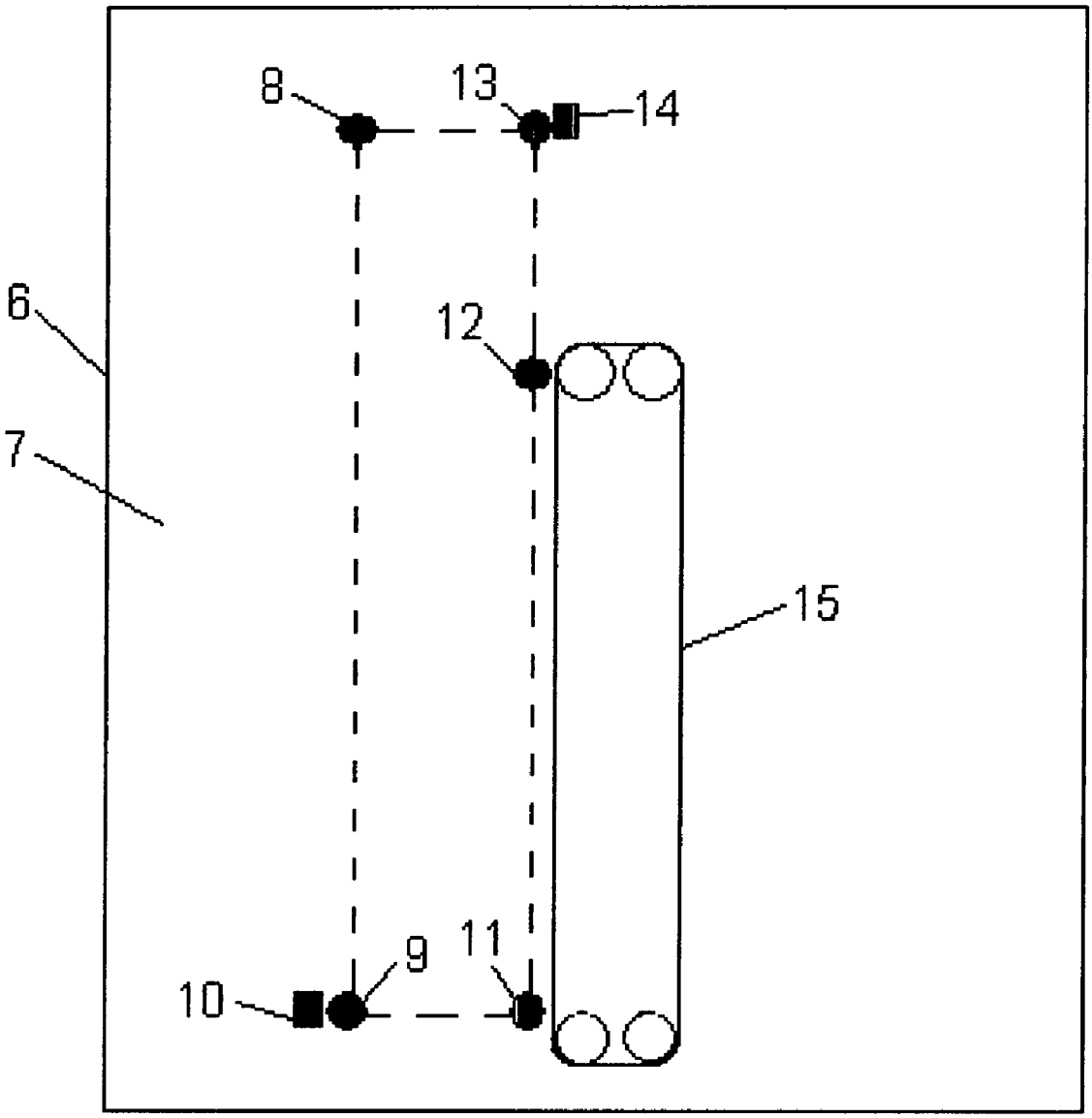
FIG. 4 is a flow chart (machine #1 and machine #2 both use the same flow chart).

Number 6. is a large tank full of liquid (FIG. 4)

Number 7 is liquid. (FIG. 4)

Number 8 is the starting position for the machine. (FIG. 4)

Number 9 is the position where the machine abruptly stops. (FIG. 4)

Number 10 is the bottom stop. (FIG. 4)

Number 11 is where the machine attaches to the load. (FIG. 4)

Number 12 is where the machine detaches from the load. (FIG. 4)

Number 13 is where the machine abruptly stops again. (FIG. 4)

Number 14 is the upper stop. (FIG. 4)

Number 15 is the load. (FIG. 4)

Number 16 is a piston lock for the extended position. (FIG. 2)

Number 17 is a piston lock for the un-extended position (FIG. 1)

Figure 7:
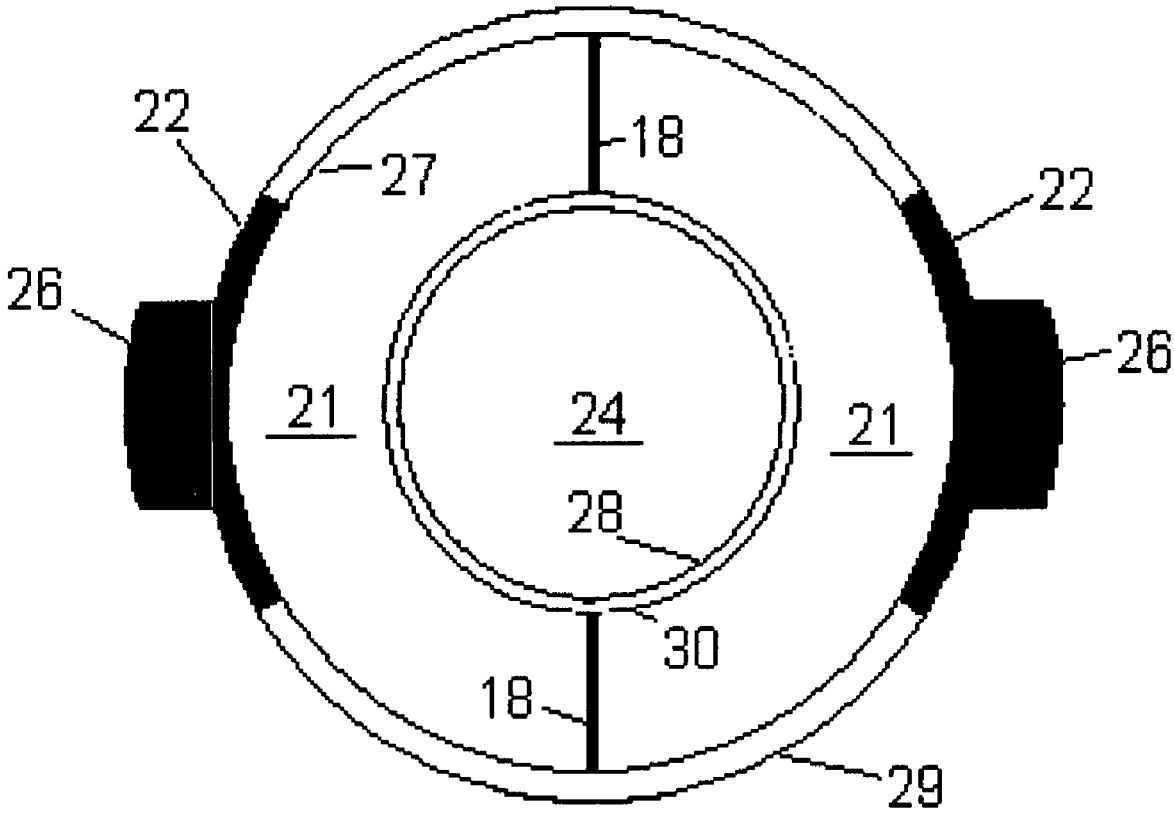
FIG. 7 is a top view looking down of machine #2

Number 18 are tank dividers. (FIG. 7)

Figure 5:
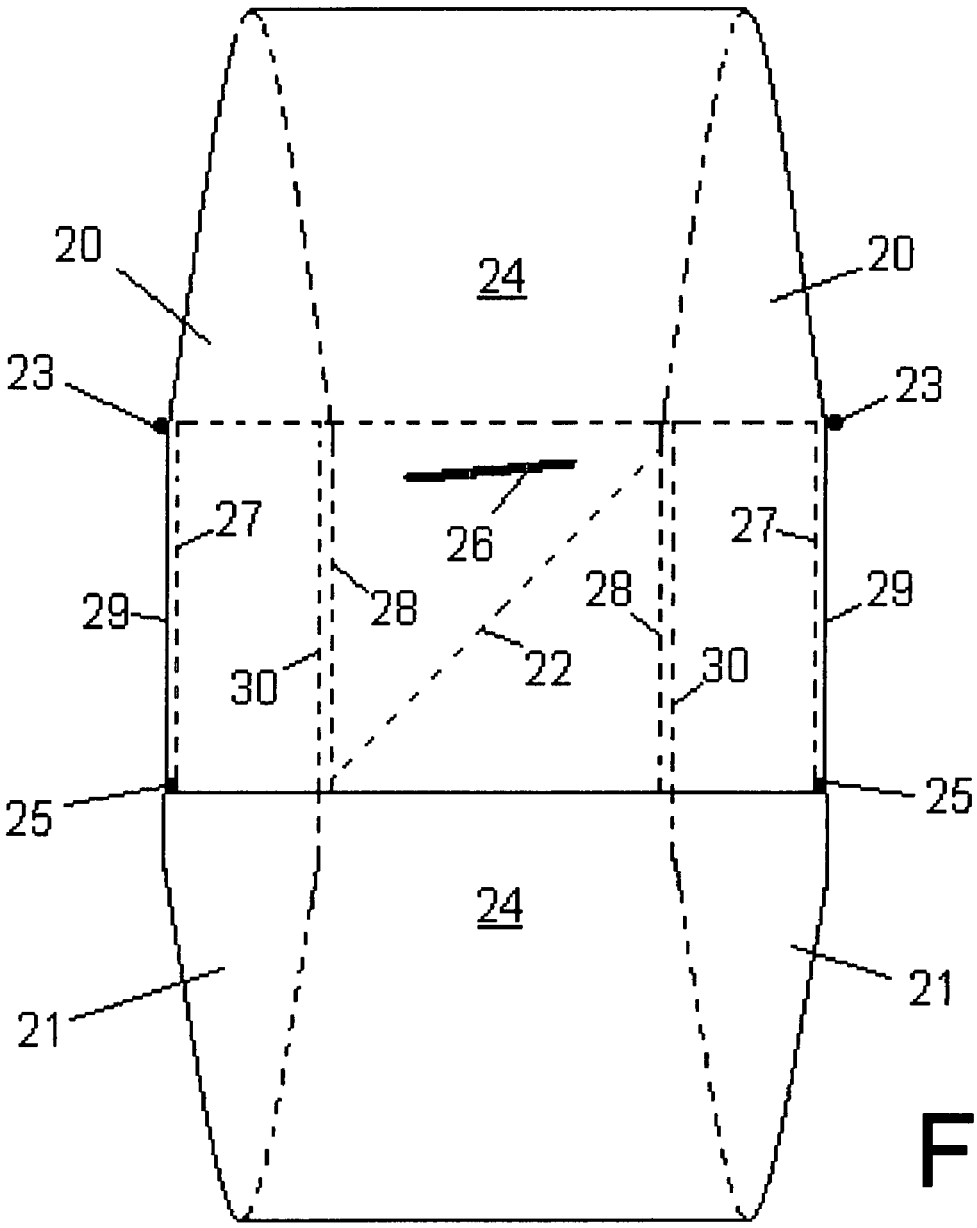
FIG. 5 is a side view of machine #2 in a un-expanded position

Number 20 is a tank in the upper part of the machine. (FIG. 5)

Figure 6:
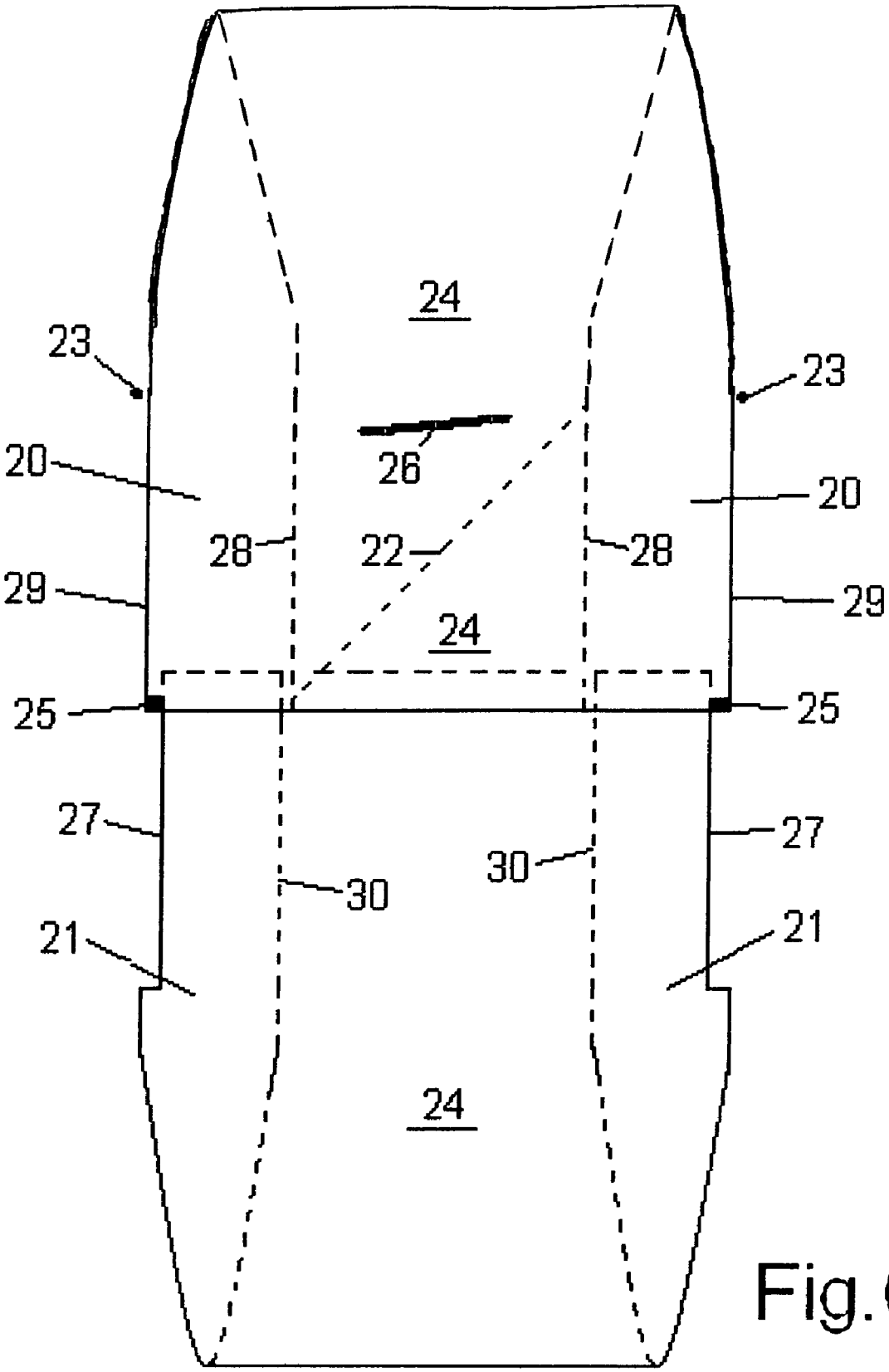
FIG. 6 is a side view of machine #2 in a expanded position.

Number 21 is a tank in the lower part of the machine. (FIGS. 5,6)

Number 22 are screw threads. (FIGS. 5,6)

Number 23 are stops. (FIGS. 5,6)

Number 24 is the hollow center of the machine. (FIG. #5,#6)

Number 25 are locks (FIGS. 5,6)

Number 26 are the wings that make the machine spin. (FIG. 5, 6, 7)

Number 27 is the outer wall of tank number 21. (FIG. 5, 6, 7)

Number 28 is the inner wall of tank number 20. (FIG. 5, 6, 7)

Number 29 is the outer wall of tank number 20. (FIG. 5, 6, 7)

Number 30 is the inner wall of tank number 21. (FIG. 5, 6, 7)

Figure 8:
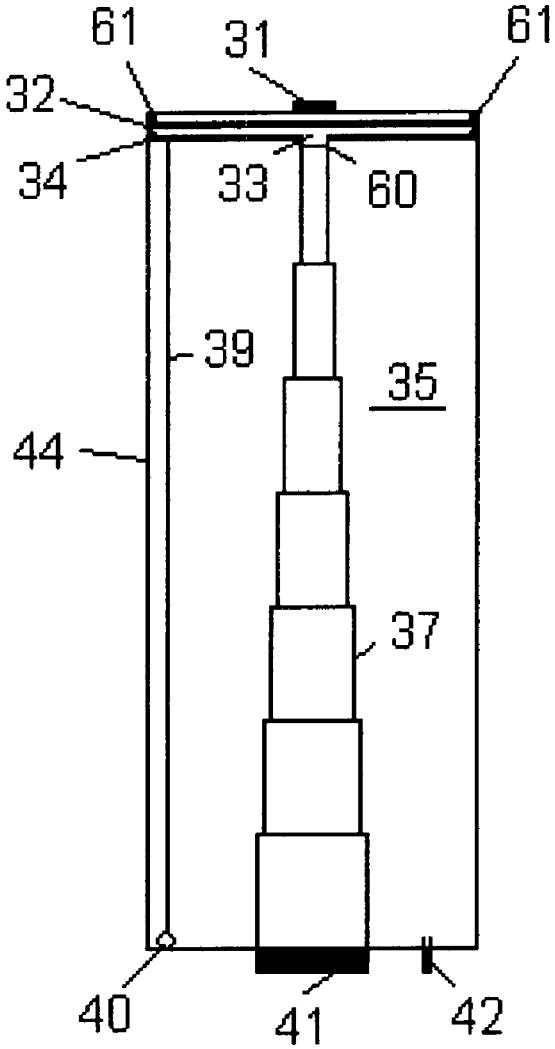
FIG. 8 is a side view of the tank-car with the telescoping hydraulic cylinder in the extended position.

Number 31 is a valve that lets the liquid (36) in and out of the tank-car. (FIG. 8, 9, 10, 11)

Number 32 is a floating piston. The floating piston moves between the piston-like end of the telescoping hydraulic cylinder (34) and the stops (61). (FIG. 8, 9, 10, 11)

Number 33 is the liquid inside of the telescoping hydraulic cylinder and pipe (45). (FIG. 8, 9, 10, 11)

Number 34 is the piston-like end of the telescoping hydraulic cylinder. (FIG. 8, 9, 10, 11)

Figure 10:
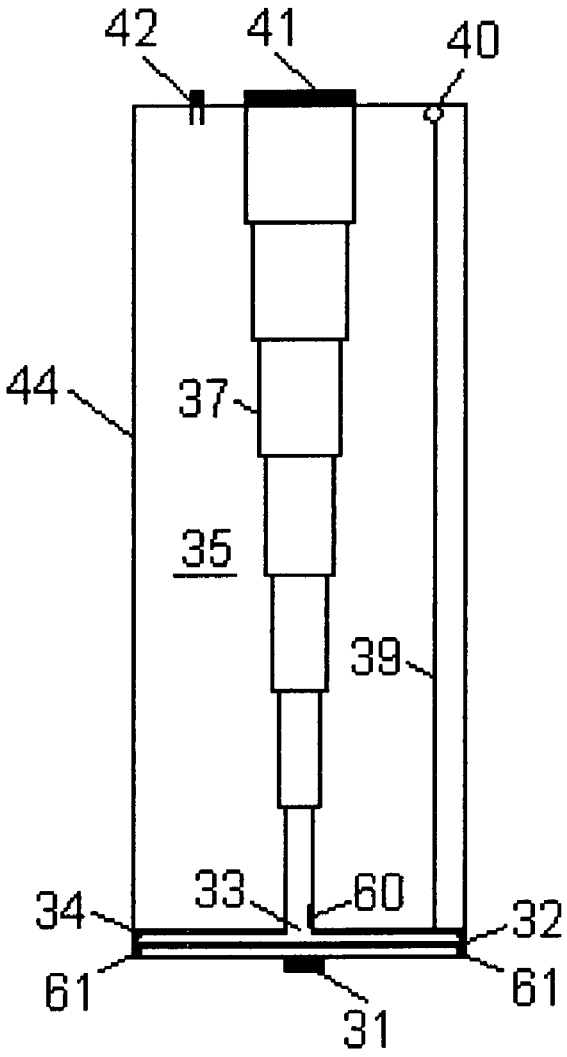
FIG. 10 is a side view of the tank-car with the telescoping hydraulic cylinder in the extended position. 25

Number 35 is the gas in the tank-car. (FIGS. 8,10)

Figure 9:
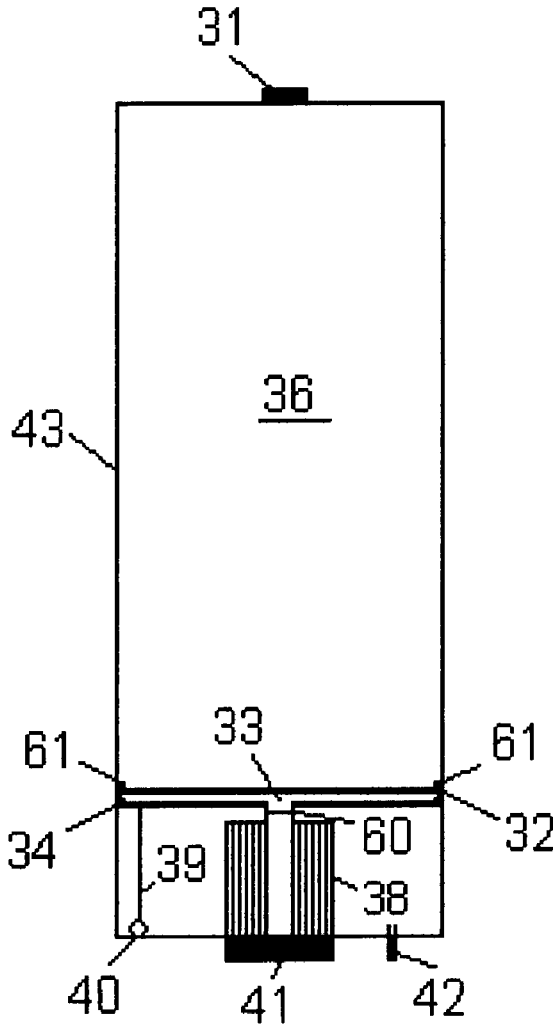
FIG. 9 is a side view of the tank-car with the telescoping hydraulic cylinder in the un-extended position.
Figure 11:
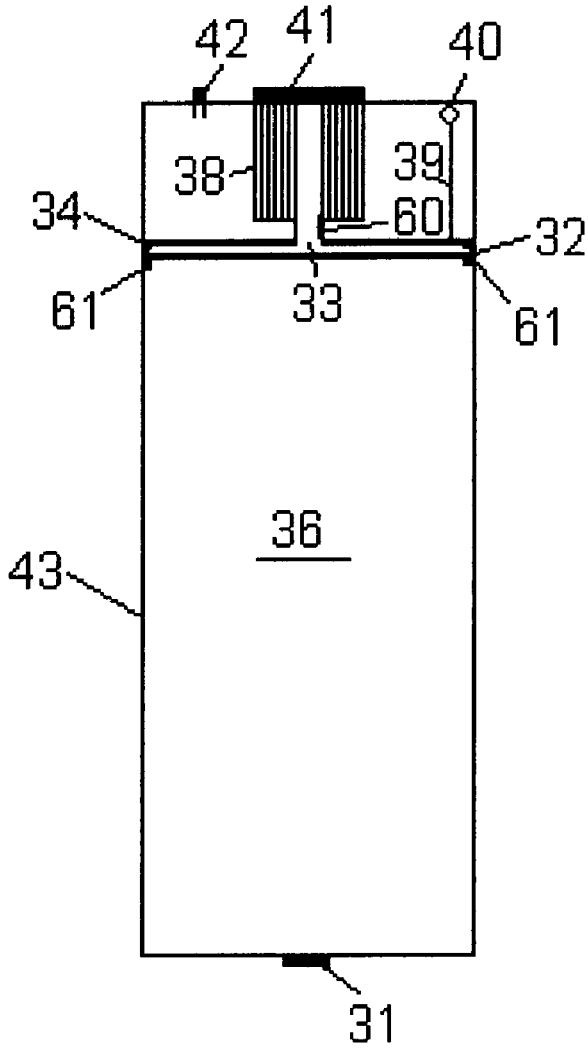
FIG. 11 is a side view of the tank-car with the telescoping hydraulic cylinder in the un-extended position.

Number 36 is the liquid in the tank-car. (FIGS. 9,11)

Number 37 is the telescoping hydraulic cylinder in the extended position. (FIGS. 8,10)

Number 38 is the telescoping hydraulic cylinder in the un-extended position. (FIGS. 9,11)

Number 39 is a cable that pulls the telescoping hydraulic cylinder and the piston (34) from a extended position to a un-extended position. (FIG. 8, 9, 10, 11)

Number 40 is a wench that pulls the cable (39). (FIG. 8, 9, 10, 11)

Number 41 is a connector and shut-off valve that lets liquid (33) in and out of the hydraulic telescoping cylinder. It is also where Number 45 attaches to the tank-car. (FIG. 8, 9, 10, 11)

Number 42 is a connector and shut-off valve that lets gas in and out of the tank-car. It is also where Number 46 attaches to the tank-car. (FIG. 8, 9, 10, 11)

Number 43 is the tank-car with the hydraulic telescoping cylinder in the un-extended position. (the tank-car is full of liquid) (FIGS. 9,11)

Number 44 is the tank-car with the hydraulic telescoping cylinder in the extended position. (the tank-car is full of gas) (FIGS. 8,10)

Figure 12:
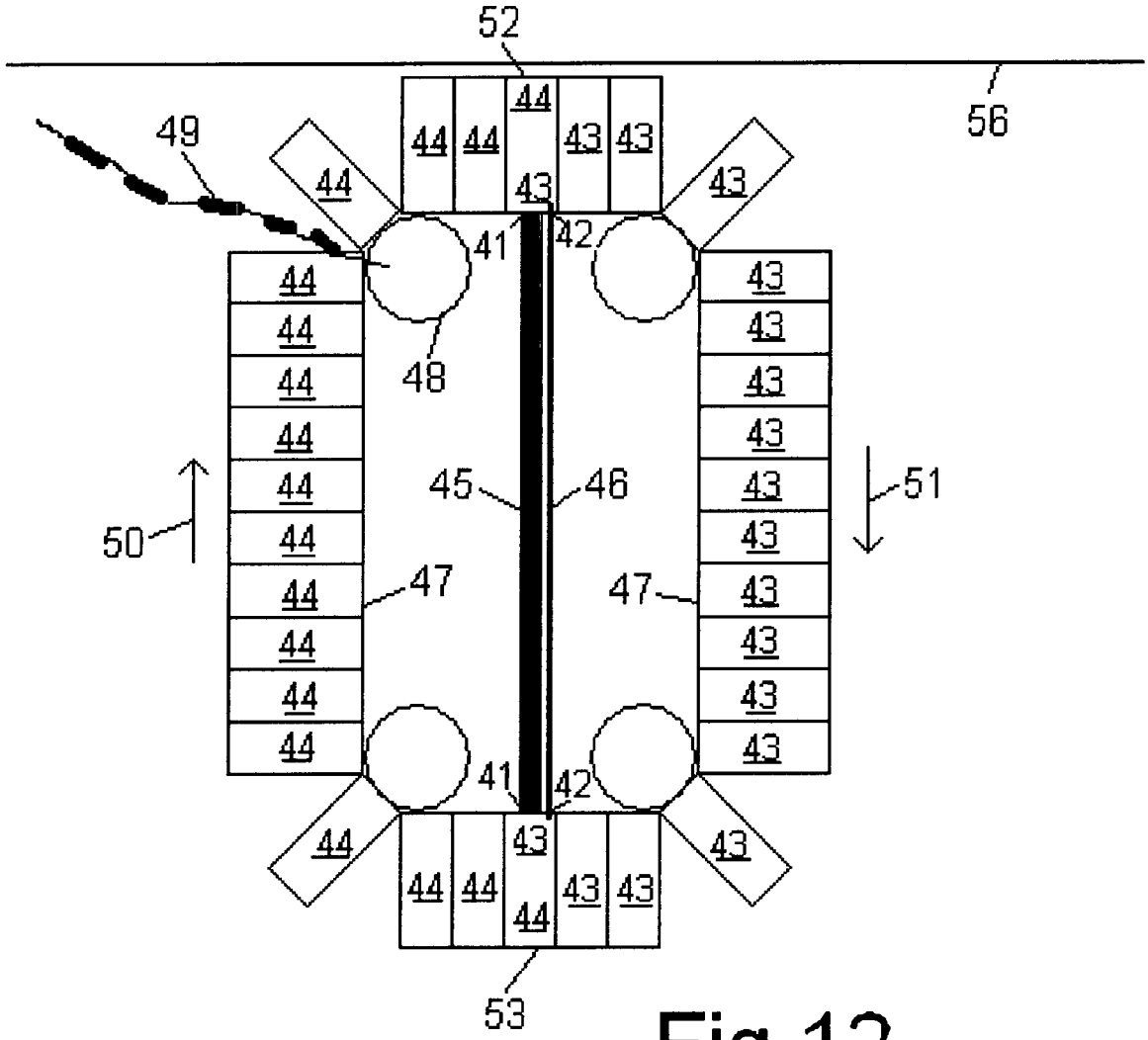
FIG. 12 is a flow chart for machine #3.

Number 45 is a pipe full of liquid (33). (FIG. 12)

Number 46 is a pipe full of gas (35). (FIG. 12)

Number 47 is a track that the tank-cars are attached to. (FIG. 12)

Number 48 is a generator. (FIG. 12)

Number 50 and 51 are arrows indicating the direction of movement for the tank-cars. (FIG. 12)

Number 52 is the position on the flow chart where the tank-car changes from number 44 to number 43. (FIG. 12)

Number 53 is the position on the flow chart where the tank-car changes from number 43 to number 44. (FIG. 12)

Figure 13:
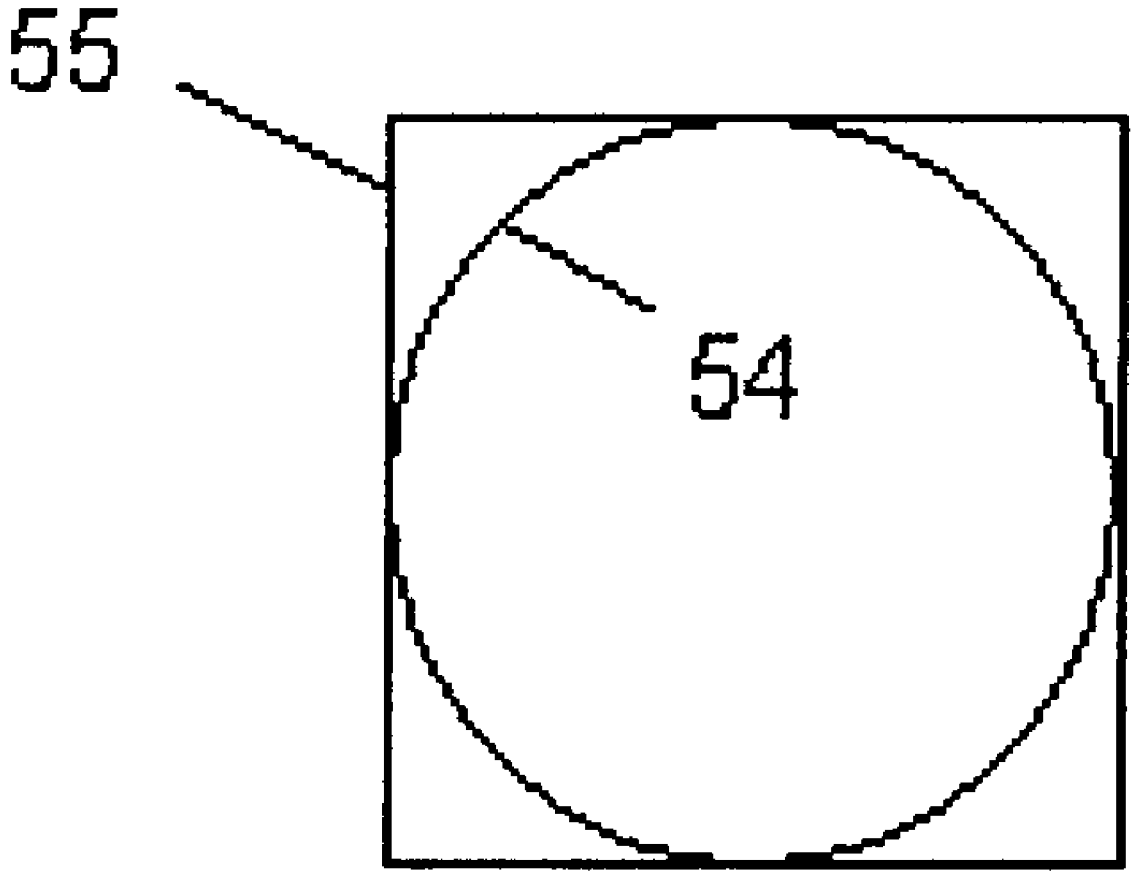
FIG. 13 is a top view looking down on the tank-car.

Number 54 is the round inter wall of the tank-car. (FIG. 13)

Number 55 is the square outer wall of the tank-car. (FIG. 13)

Number 56 is a line indicating the top of the liquid. (FIG. 12)

Number 61 is a stop. (FIG. 8, 9, 10, 11)

DETAILED DESCRIPTION OF THE INVENTION

A empty tank submersed in a body of liquid will float to the surface, as the tank floats up it will do work. It is the goal of this machine to empty the tank after the tank has been submersed, and in the process of emptying the tank do less work than the empty tank does when it floats up.

A tank full of liquid will sink, assuming the tank itself is heavier than the liquid. As the tank full of liquid sinks both the tank and the liquid in the tank accelerate do to the force of gravity. As the tank and the liquid in the tank accelerate they both build momentum. The momentum of the liquid and part of the tank are the forces used to expand the machine.

Machine # 1

The un-expanded machine (FIG. 1) starts its cycle at position #8 in FIG. 4. The un-expanded machine free-falls thru the liquid (7) in the large tank (6) as the machine falls thru the liquid the piston-like tanks full of liquid (3*a*) and the nose-cone full of liquid (4) build momentum until it gets to position #9. At position #9 the top part of the un-expanded machine is abruptly stopped by the bottom stop (10) in the tank, and retractable stop (5) on the un-expanded machine.

When the top part of the un-expanded machine is abruptly stopped it becomes a expanded machine (FIG. 2). The momentum of the piston-like tanks full of liquid (3*a*) and the nose-cone full of liquid (4) pulls the piston-like tanks full of liquid (3*a*) out of tanks 2*a* and 2*c*. Expanding the machine.

Tank 2*a* turns into tank 2*b*. And tank 2*c* turns into tank 2*d*. The gas pressure in tanks 2*b* and 2*d* is lowered. The gas pressure is equalized between tank 2*b* and 2*d* by the hole in the piston shaft (1). The piston-like tanks full of liquid in the expanded position (3*b*) are than locked into position by the piston locks (16). The expanded machine should now be lighter than the liquid it displaces.

Next the machine is transferred from the #9 position to the #11 position. At the #11 position the machine is attached to a load (15) Next the machine floats up to the #12 position doing work between the 11$^{th}$ and 12$^{th}$ position. At the position #12 the machine is detached from the load (15) and aloud to float up, accelerating freely until it gets to the #13 position. At the #13 position the top part of the machine is again abruptly stopped by the upper stop (14) and the retractable stop (5) The low gas pressure in tanks 2*b* and 2*d* combined with the momentum of the piston-like tanks full of liquid (3*b*) and the nose-cone (4) force the pistons (3*b*) up into tank 2*a* and 2*c*, the machine becomes un-expanded. The piston locks (17) lock the pistons in the un-expanded position.

At that point the weight of the machine is greater than the weight of the displaced liquid and the machine will sink. The machine is than transferred from position #13 to Position #8 completing the cycle.

The same liquid should be used in tanks 3*a*, 3*b*, 6 and the nose-cone (4)

The energy added to the system comes from the momentum of the falling and rising machine and the position of the expanded and un-expanded machine.

Machine #2

The machine has two main parts, the upper tank (20) and the lower tank (21). The upper tank (20) contains gas, the lower tank (21) contains liquid.

The machine is expandable, FIG. 5 is the machine in the un-expanded position, FIG. 6 is the machine in the expanded position. The way the machine expands is the lower and upper tanks unscrew from each other. Number 18 are tank dividers, Number 22s are screw threads. Number 23s are stops. Number 24 is the hollow center of the machine. Number 26s are the wings that make the machine spin as it falls.

The machine starts the cycle at position #8 in FIG. 4. The machine free-falls thru the liquid (7) in the large tank (6) As the machine accelerates in the downward direction it also spins. The protruding wings (26) are angled slightly to make the machine spin. The tank dividers (18) keep the liquid in the lower tank (21) spinning at the same speed as the tank they are in. The machine builds both linear momentum in the downward direction and angular momentum.

The machine free-falls from position 8 to position 9. At position 9 the gas filled tank (20) in the upper part of the machine is abruptly stopped from spinning and falling by the stop in the tank (10) and by the stops on the machine (23). The lower tank (21) filled with heavy liquid keeps spinning and falling. The lower tank (21) unscrews from the upper tank (20) expanding the machine. The lower tank is locked in the expanded position by the locks (25). The machine changes from the un-expanded position in FIG. 5 to the expanded position in FIG. 6. The buoyancy of the machine increases, the weight of the liquid the machine displaces increases, the machine should now float. As the machine expands the gas pressure in the upper tank (20) decreases.

Next the machine is transferred from the #9 position to the #11 position. At the #11 position the machine is attached to a load (15) The machine . . . floats up to the #12 position. The machine does work between the 11$^{th}$ and 12$^{th}$ position. At position #12 the machine is detached from the load (15) and aloud to freely accelerate up, building both linear momentum in the up direction and angular momentum. At position #13 the upper part of the machine (20) is abruptly stopped by the upper stop in the tank (14) and the stops on the machine (23). The combination of the low pressure in the upper tank (20)

and the linear and angular momentum of the liquid filled lower tank (21) causes the lower tank (21) to screw up into the upper tank (20). The machine is locked in the un-extended position by the locks (25). At this point the machine should be heavier than the liquid it displaces and will sink. At position #13 the machine goes from the expanded position FIG. 6 to the un-expanded position FIG. 5. The machine is than transferred from position #13 to position #8 and the cycle is complete.

Machine #3

This tank-car uses the weight of the liquid above it, and some of the work the empty tank-cars do as they float up to remove the liquid from the submerged tank-car.

In FIG. 12 the empty tank-cars (44) are floating up, the tank-cars (43) full of liquid (36) are sinking, the process of the tank-cars floating and sinking causes the track (47) to move powering the generator (48) and the wench (40)

The initial supply of gas (35) in the tank-cars (44) needs to be supplied by a external source.

At position 52 in FIG. 12 the tank-car changes from being full of gas (44) to being full of liquid (43), directly below it at position 53 another tank-car changes from being full of liquid (43) to being full of gas (44). The tank-car at position 52 than proceeds to sink, and the tank car at position 53 proceeds to float up doing work. The process of emptying the tank-car of liquid and filling it with gas at position 53 (the bottom) and the process of removing the gas and filling the tank-car with liquid at position 52 (the top) is as follows.

At position 52 (the top) in FIG. 12 the tank-car gets there full of gas with the hydraulic telescoping cylinder in the extended position (44) The tank-car is than shifted off the moving track (47) and stops. From the other side of the track another tank-car that has already been processed moves in to replace it. At the same time at position 53 (the bottom) a tank-car gets there full of liquid (43) FIG. 11, that tank-car is than shifted off the moving track (47) and stopped. A tank-car that has already been processed moves in to replace it.

The tank-car (44) full of gas (35) at the top (position 52) now connects to the tank-car (43) full of liquid (36) at the bottom (position 53) via two pipes. One of the pipes contains liquid (33) the other contains gas (35). The pipe that contains liquid connects the hydraulic telescoping cylinder (37) of the top tank-car to the hydraulic telescoping cylinder (38) of the bottom tank-car, the connection is made at the connector and shut-off valve (41) for pipe that contains liquid (45). The pipe that contains gas (46) is connected at the connector and shut-off valve (42). The two pipes allow the free flow of liquid (33) and gas (35) between the tank-car at the top and the tank-car at the bottom. At this point the tank-car at the top looks like FIG. 8, the tank-car at the bottom looks like FIG. 11.

Next the valves 31, 41, 42 are opened on both the top and bottom tank-cars. Liquid (36) starts to flow into the top tank-car thru valve Number 31. The wench (40) in the top tank-car starts. The wench (40) pulls the cable (39), the cable is attached to the piston at the end of the hydraulic telescoping cylinder (34). As the piston (34) in the top tank-car is pulled down, the hydraulic pressure inside the hydraulic telescoping cylinder (37) increases enough to force the un-expanded hydraulic cylinder (38) to expand, as it expands it forces the piston in the bottom tank-car down. As the piston in the bottom tank-car moves down it forces the liquid (36) in the tank-car out thru valve 31. Gas (35) from the top tank-car (44) flows thru line 46 to replace the liquid (36) being removed from the bottom tank-car (43). The hydraulic telescoping cylinder in the bottom tank-car becomes fully extended (37), and the hydraulic telescoping cylinder in the top tank-car becomes fully un-extended (38).

The tank-car in the Number 52 position (the top) should now look like FIG. 9, and the tank-car in the Number 53 position (the bottom) should now look like FIG. 10. The bottom tank-car is full of gas, and the top tank-car is full of liquid. At the top tank-car Number 44 turned into tank-car Number 43. At the bottom tank-car Number 43 turned into tank-car Number 44. The processed tank-cars are than shifted back onto the track (47). The tank-car at the bottom (44) floats up doing work, the tank-car at the top (43) sinks.

The process is repeated on the next tank-cars in line.

The liquid (33), inside the hydraulic cylinder (37) (38) and the pipe (45) is separate from the other liquid (36).

FIG. 13 is a top view of the tank-car looking down. The inner part of the tank-car is a cylinder (54), the outer part of the tank-car (55) is a rectangle. The outer rectangular part of the tank-car reduces drag as the tank-car moves thru the liquid.

There is a continuous column of liquid from the piston in the bottom tank-car to the piston in the top tank-car, the pressure of the liquid in that column offsets the external pressure on the piston in the bottom tank-car.

I claim:

1. A machine to convert gravity to mechanical energy as the machine cycles between an un-expanded position and an expand position, the machine comprising:

a) a first tank (2*a*) with pressurized gas and a first piston-like tank (3*a*) full of liquid in the first tank in the un-expanded position, the pressurized gas in the first tank being lowered as the first piston-like tank full of liquid is moved out of the first tank to the expanded position;

b) a second tank with pressurized gas and a second piston-like tank full of liquid in the second tank in the un-expanded position, the pressurized gas in the second tank being lowered as the second piston-like tank full of liquid is moved out of the second tank to the expanded position;

c) a hole in a piston shaft of the first piston-like tank that allows the gas to travel between the first and second tank;

d) a nose-cone full of liquid connected to the second piston-like tank full of liquid;

e) a retractable stop on the first tank, f) a piston lock for each of the first and second expanded piston-like tanks full of liquid;

g) a piston lock for each of the first and second un-expanded piston-like tanks full of liquid; and wherein the machine is submersed in a body of liquid and free falls in the un-expanded position;

wherein the retractable stop suspends the free fall of the machine to move the machine into the expanded position;

wherein the machine floats up after being expanded to do work; and wherein the retractable stop suspends the floating up of the machine to move the machine into the un-expanded position.

2. A machine to convert gravity to mechanical energy as the machine cycles between an un-expanded position and an expand position, the machine comprising:

a) a tank containing gas with screw threads on a inner wall thereof;

b) a tank containing liquid with screw threads on a outer wall thereof; the tank containing liquid in threaded connection with the screw threads of the tank containing gas;

c) tank dividers in the tank containing gas;

d) tank dividers in the tank containing liquid;

e) stops on the outer wall of the tank containing gas;

f) locks on the inner wall of the tank containing gas to lock the tank containing liquid in the extended position when the tank containing liquid unscrews from the tank containing gas; and g) wings on the outer wall of the tank containing gas to spin the machine and build angular momentum, wherein the machine is submersed in a body of liquid and free falls and spins in the un-expanding position;

wherein the retractable stop suspends the free fall and spin of the tank containing gas and move the machine into the expanded position as the tank containing liquid continues to free fall and spin;

wherein the machine floats up and spins after being expanded to do work; and wherein the retractable stop suspends the floating up and spin of the tank containing gas to move the machine into the un-expanded position as the tank containing liquid continues to float up and spin.

3. A machine to convert gravity to mechanical energy, comprising:

a) a plurality of tank-cars with hydraulic telescoping cylinder that cycle between an extended position and an un-extended position;

b) a piston-like end of the hydraulic telescoping cylinder (34) with stops (61) separating the tank into a liquid tank (36) and a gas tank (35);

c) a floating piston (32) in the tank-car connected to the piston-like end of the hydraulic telescoping cylinder;

d) a cable (39) connected to the piston-like end of the hydraulic telescoping cylinder and controlled by a wench (40) in the tank-car;

e) a valve (31) in the tank-car for controlling liquid into and out of the liquid tank (36);

f) a pipe full of liquid (45);

g) a pipe full of gas (46);

h) a first connector and shut-off valve (41) in the tank-car for controlling liquid into and out of the hydraulic telescoping cylinder to and from the pipe full of liquid (45);

i) a second connector and shut-off valve (42) in the tank-car for controlling gas into and out of the gas tank (35) to and from the pipe full of gas (46);

wherein the plurality of tank-cars are attached to a track (47);

wherein the machine is immersed in a body of liquid;

wherein some tanks fall with the hydraulic telescoping cylinder in the un-extended position, while some tanks float up with the hydraulic telescoping cylinder in the extended position to move the tract;

wherein one tank-car with the hydraulic telescoping cylinder in a extended position is shifted off the moving track, while one other tank-car with the hydraulic telescoping cylinder in an un-extended position is shifted off the moving tract;

wherein with the valve, The first connector and shut-off valve, and the second connector and shut-off valve open, the wench in the one tank-car is operated to pull the hydraulic telescoping cylinder into an un-extended position, to fill the liquid tank of the one tank-car with liquid, remove liquid from the liquid tank of the other tank-car, transfer liquid from the hydraulic telescoping cylinder of the one tank-car to the hydraulic telescoping cylinder of the other tank-car, and transfer gas from the gas tank of the one tank-car to the gas tank of the one other tank-car; and wherein the moving track powers a generator (48).

* * * * *